US005146800A

United States Patent [19]

Farrell

[11] Patent Number: 5,146,800

[45] Date of Patent: Sep. 15, 1992

[54] TRAFFIC CONTROL BARRIER

[75] Inventor: Peter J. Farrell, Middlesex, England

[73] Assignee: APT Controls Limited, Harrow, England

[21] Appl. No.: 670,074

[22] Filed: Mar. 15, 1991

[30] Foreign Application Priority Data

Mar. 16, 1990 [GB] United Kingdom ..... 9005921

[51] Int. Cl.[5] ..... F16H 21/44; E01F 13/00

[52] U.S. Cl. ..... 74/100.1; 404/6

[58] Field of Search ..... 74/100.1; 404/6, 9

[56] References Cited

U.S. PATENT DOCUMENTS

| | | | |
|---|---|---|---|
| 3,490,309 | 1/1970 | Gustavson | 74/100.1 X |
| 4,318,079 | 3/1982 | Dickinson | 404/6 X |
| 4,524,637 | 6/1985 | Yoshizumi | 74/100.1 X |
| 4,654,494 | 3/1987 | Wuthrich | 74/100.1 X |
| 4,681,479 | 7/1987 | Wagner et al. | 404/6 |

FOREIGN PATENT DOCUMENTS

| | | | |
|---|---|---|---|
| 2108134 | 8/1972 | Fed. Rep. of Germany . | |
| 2325966 | 12/1973 | Fed. Rep. of Germany | 404/6 |
| 2408467 | 8/1975 | Fed. Rep. of Germany . | |
| 8802125 | 6/1988 | Fed. Rep. of Germany . | |
| 2016004 | 4/1970 | France . | |
| 2261373 | 9/1975 | France . | |
| 2307674 | 11/1976 | France . | |

*Primary Examiner*—Allan D. Herrmann
*Assistant Examiner*—Julie Krolikowski
*Attorney, Agent, or Firm*—Needle & Rosenberg

[57] ABSTRACT

Known traffic barriers require heavy duty motors to raise and lower the arm. Accordingly, a traffic barrier arm operating mechanism comprises a component for raising and lowering an arm connected to a drive shaft. A crank arm is mounted on the drive shaft and a draw rod is connected to the crank arm, the draw rod passing through a bearing in which it is slidably pivoted. A spring guide is mounted at the bearing, the draw rod extending into the spring guide. The end of the draw rod remote from the crank arm carries a spring compression element engaging one or more springs contained within the spring guide and is arranged to compress the or each spring within the spring guide on rotation of the drive shaft in the first direction which, in use, causes the barrier arm to be lowered.

9 Claims, 3 Drawing Sheets

6
8
9
6
10
3
7
8
1
12
11
15
14
22
19
2
13
16
16'
17
18
L
20

TRAFFIC CONTROL BARRIER

BACKGROUND OF THE INVENTION

The present invention relates to traffic control barriers and, more particularly, to traffic control barriers of the type having an arm which is lowered to provide a barrier and which can be raised to allow traffic to pass past the barrier.

Existing motorised barriers require heavy duty motors in order to raise and lower the arm, despite the counterbalancing of the arm. This is because it is difficult to balance the arm at all positions and, therefore, the residual force on the arm and hence on the motor varies as the arm moves. Thus the motor must be rated sufficiently highly to cope with the maximum gravitational force on the arm that will need to be overcome during its movement.

The present invention sets out to overcome this problem and has the objectives of enabling the use of smaller capacity motors than hitherto, whilst ensuring a smoother arm movement, using simple, reliable components and providing a fail-safe mechanism, to prevent the arm from falling if the mechanism fails and to prevent the arm from being raised if a relatively large load is added to the arm, such as a child swinging on the arm. It is also an objective of the present invention to produce a compact structure.

SUMMARY OF THE INVENTION

According to the present invention, a traffic barrier arm operating mechanism comprises means for raising and lowering an arm connected to a drive shaft; a crank arm mounted on the drive shaft; a draw rod connected to the crank arm, the draw rod passing through a bearing in which it is slidably pivoted; and, a spring guide mounted at the bearing and into which the draw rod extends, the end of the draw rod remote from the crank arm carrying a spring compression element engaging one or more springs contained within the spring guide and being arranged to compress the or each spring within the spring guide on rotation of the drive shaft in a first direction which, in use, causes the barrier arm to be lowered.

Preferably, the shaft is motor driven, but it may also be manually rotated through a gearbox if required, for example, if mains power is not readily available.

The spring guide may be pivotally or slidably mounted in the bearing, or it may be both slidable and pivotable in the bearing.

The bearing is preferably located adjacent the drive shaft, to one side of it and below it a distance about equal to the length of the crank arm from the shaft to the draw rod. The draw rod itself is preferably located offset from the axis of the drive shaft, whereby the angle and/or distance through which the draw rod and spring guide are moved on rotation of the shaft is minimised.

The use of compression springs simplifies the construction and eases manufacture as these are easier to manufacture in large gauge wire than tension springs. Tension springs are also inherently more dangerous.

By achieving balancing of the arm over substantially the whole of its movement, a lower rated motor can be used, since the motor only has to overcome the inefficiencies in the necessary gearing and other frictional losses in the mechanism. Alternatively, a motor of conventional rating may be used so that the arm may be raised and lowered more quickly. Preferably, the motor is slightly larger than strictly necessary, in order to provide a measure of safety, for example, to ensure lifting of the barrier arm under adverse conditions, e.g. low mains voltage.

The balancing also ensures a smooth operation, since very little shock load is received onto the arm from the low power motor and, at the same time, the moment of inertia of the arm system is low In addition, if a child, for example, were to sit on the lowered arm, the motor would stall and would therefore not be able to raise the arm and child, thus providing a further safety feature.

In the unlikely event of the mechanism failing, for example, by fracture of one or all of the springs, the gearing in the gear box is sufficient to hold the arm in position.

One example of a mechanism constructed in accordance with the present invention, together with a modification thereof, will now be described with reference to the accompanying drawings, in which:

DETAILED DESCRIPTION OF THE INVENTION

Figure 1:
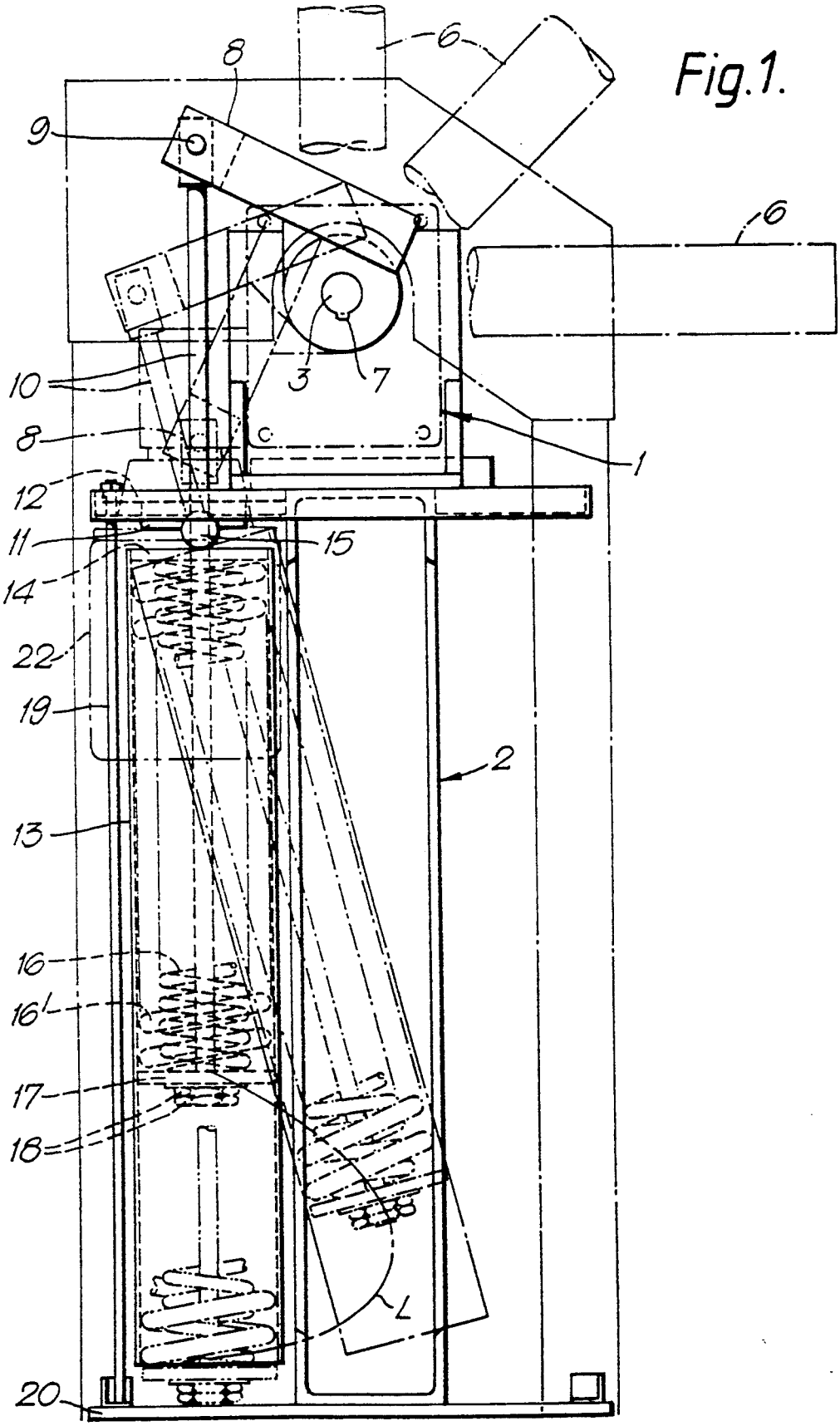
FIG. 1 is a side elevation of the mechanism, without its housing, showing the arm and other moving components in three positions.
Figure 2:
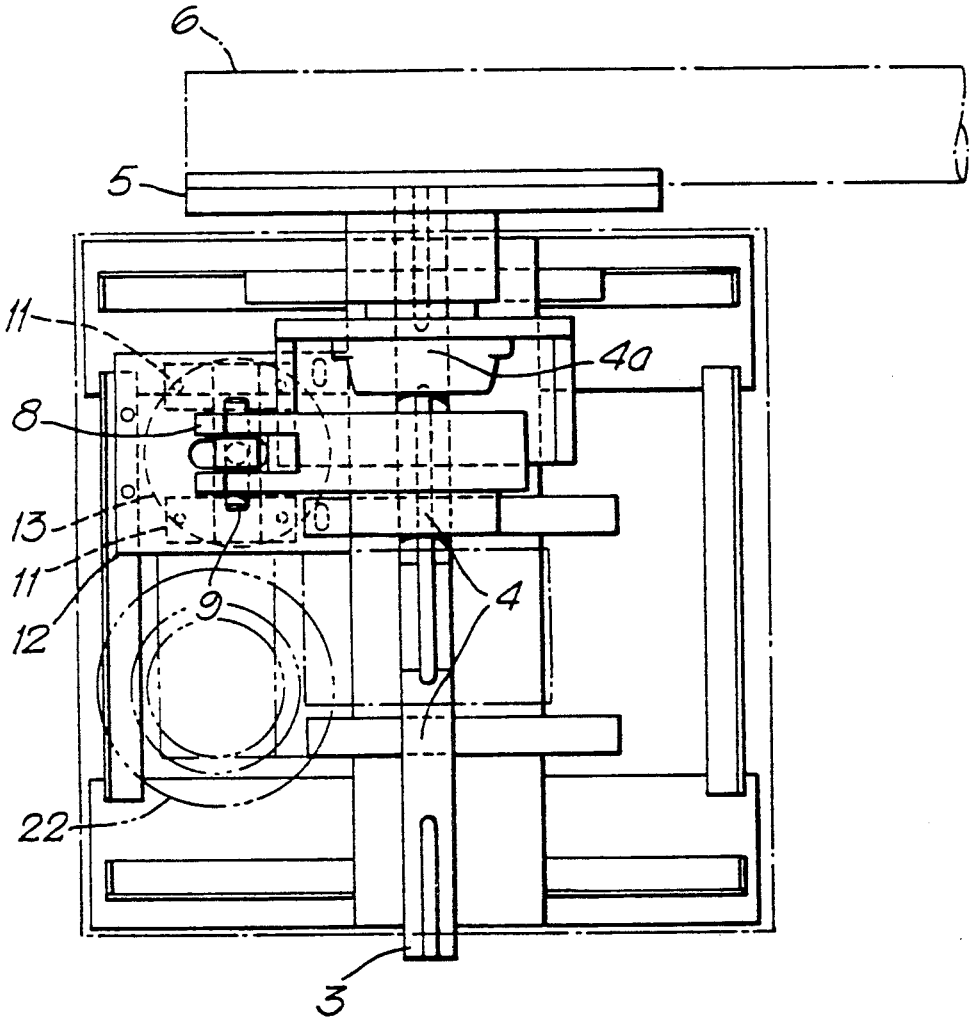
FIG. 2 is a plan view of the mechanism.

The barrier mechanism has a gearbox i mounted on a support frame 2, the gearbox housing an electric instant reverse motor 22, but which, through the gears (not shown) in the gearbox, drives an output shaft 3. The output shaft is supported in a pair of bearings 4 within the gearbox 1 and a third, outrigger bearing 4a, and carries a flange plate 5 on which the barrier arm 6 is mounted in use.

Affixed to the output shaft, by means of a key 7, is a crank arm 8 which, by means of a link pin 9, carries a draw rod 10. The draw rod passes between a pair of bearings 11 mounted on a pivot plate 12 which is rigidly fixed to the support 2, the bearings 11 being spaced slightly to one side and below the output shaft 3. The draw rod 10 is slidable within a tubular spring guide 13 which has a closure plate 14 at its top and which carries, at its upper end on the closure plate 14, a bearing pin 15 which engages the bearings 11 so as to allow pivotal movement of the spring guide 12.

The draw rod 10 supports a pair of helical compression springs 16, 16' of different diameters and opposite twists (to prevent intermeshing) and carries, at its lower end, a spring retainer plate 17. The springs are held under compression between the closure plate 14 and the retainer plate 17, pre-compression of the springs being achieved, as may be required, by locking nuts 18 screw-threaded onto the lower end of the draw rod 10 and retaining the retainer plate 17. The pre-compression of the springs ensures that the bearing pin 15 is engaged with the bearing 11 at all times and is adjustable (by means of the nuts 18) to accommodate differences in arm length or loading. Major differences in arm length can be accommodated by using different springs and/or different numbers of springs, but it is envisaged that a single size of motor will be usable with barrier arms of different lengths.

In use, with the barrier arm 6 in the raised position shown in FIG. 1, rotation of the output shaft 3 starts to lower the arm 6. As this occurs, the springs 16,16' start to compress under the action of the rising draw rod 10 carrying the retainer plate 17 and the draw rod 10 starts to swing on the pivot provided by the bearings 11 and the pin 15, away from the vertical initial position shown. Tie rods 19 between the pivot plate 12 and the base 20 of the mechanism assist in providing rigidity during compression of the springs 16,16'.

When the barrier is halfway down (at an angle of about 45° to the horizontal and the vertical), the crank arm 8 is substantially horizontal and the draw rod 10 and spring guide 12 are at their maximum angle to the vertical. As the arm continues to fall, the crank arm 8 continues upwards, further compressing the springs, but bringing the draw rod 10 and guide 12 back towards the vertical. When the arm 6 is fully down, the springs are fully compressed, being prevented from buckling by the tubular form of the spring guide 12.

By this design, the spring force can be arranged to balance the gravitational force on the arm, substantially exactly, over the whole range of movement of the arm 6. Clearly, the balancing is effective when the arm is raised also. The locus L of movement of the retainer plate 17 is shown in FIG. 1.

The presence of the gearbox ensures that should any spring or other part fail, the arm 6 does not fall, the gearing through the gearbox retaining the arm in the position where failure occurred.

Whilst the invention has been described with reference to pivoting of the bearing pin 15 in the bearings 11, it is to be understood that the bearing pin 15 may additionally or alternatively slide in the bearings 11. The bearing pin 15 may be constrained to slide in the bearings 13 by running the lower end of the spring guide 13 in rails, the spring guide 13 staying vertical throughout the whole motion of the arm.

Figure 3:
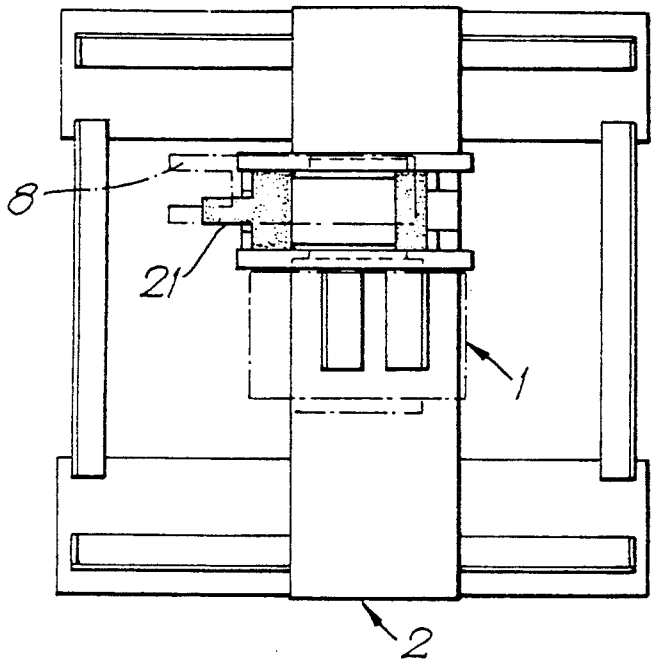
FIG. 3 is a plan view showing a modification.
Figure 4:
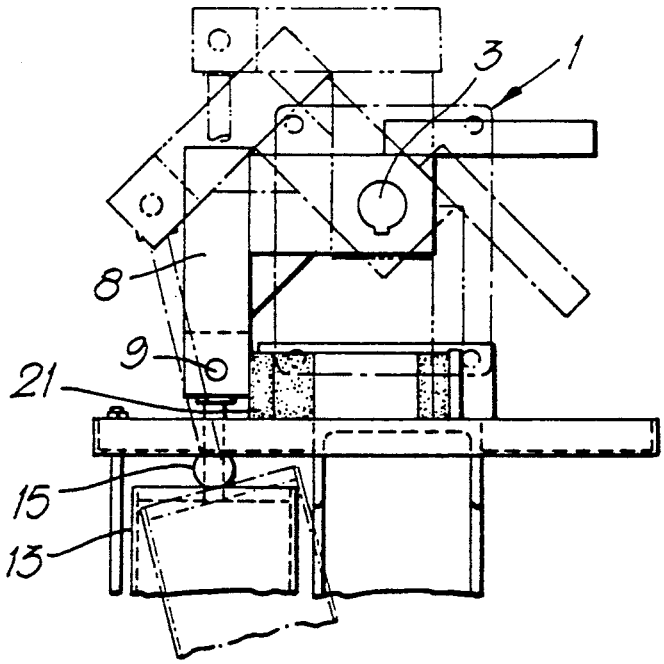
FIG. 4 is a side elevation corresponding to FIG. 3.

In addition, FIGS. 3 and 4 show the use of a rubber block 21 against which the crank arm 8 bears when the arm 6 is fully raised In use, the motor may be driven until the arm is, say 5° from vertical, at which point the motor is switched off by the automatic operation of a stop switch (not shown). The arm then "coasts" to the vertical position, compression of the block 21 preventing the transmission of shock to the mechanism.

What we claim is:

1. An operating mechanism for raising and lowering a traffic barrier arm, said mechanism comprising:

a drive shaft, said drive shaft for connecting in use to a traffic barrier arm;

a crank arm, said crank arm being mounted on said drive shaft;

a draw rod, said draw rod having first and second ends and being connected to said crank arm at said first end;

a bearing, said draw rod passing through and being slidably pivoted in said bearing;

a spring guide mounted at said bearing, said draw rod extending into said spring guide;

a spring compression element, said spring compression element being carried on said second end of said draw rod; and, at least one spring contained within said spring guide, said spring compression element being arranged to compress said at least one spring on rotation of said drive shaft in a first direction which, in use, causes said barrier arm to be lowered.

2. A mechanism according to claim 1, further comprising a motor for driving said shaft.

3. A mechanism according to claim 1, wherein said spring guide is pivotally mounted in said bearing.

4. A mechanism according to claim 3, wherein said spring guide is slidably mounted in said bearing.

5. A mechanism according to claim 1, wherein said spring guide is slidably mounted in said bearing.

6. A mechanism according to claim 1, wherein said bearing is located adjacent said drive shaft, to one side of and below said drive shaft, a distance about equal to the length of said crank arm from said shaft to said draw rod.

7. A mechanism according to claim 1, wherein said draw rod is located offset from said drive shaft

8. A mechanism according to claim 1, wherein said at least one spring is precompressed, and further comprising at least one locking nut, said at least one locking nut being screw-threaded on said draw rod at said second end and retaining said spring compression element on said draw rod, said spring precompression being adjustable by means of said at least one locking nut.

9. A traffic control barrier comprising a traffic barrier arm and an operating mechanism for raising and lowering said traffic barrier arm, said mechanism comprising:

a drive shaft, said traffic barrier arm being connected to said drive shaft;

a motor, said motor being drivingly connected to said shaft;

a crank arm, said crank arm being mounted on said drive shaft;

a draw rod, said draw rod having first and second ends and being connected to said crank arm at said first end;

a bearing, said draw rod passing through and being slidably pivoted in said bearing;

a spring guide mounted at said bearing, said draw rod extending into said spring guide;

a spring compression element, said spring compression element being carried on said second end of said draw rod; and, at least one spring contained within said spring guide, said spring compression element being arranged to compress said at least one spring on rotation of said drive shaft in a first direction which, in use, causes said barrier arm to be lowered.

* * * * *